US009545733B2

(12) United States Patent
Maruyama et al.

(10) Patent No.: US 9,545,733 B2
(45) Date of Patent: Jan. 17, 2017

(54) CUTTING APPARATUS AND PRINTING APPARATUS

(71) Applicant: CANON KABUSHIKI KAISHA, Tokyo (JP)

(72) Inventors: Ryohei Maruyama, Kawasaki (JP); Takakazu Ohashi, Kawasaki (JP); Daiki Anayama, Yokohama (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/847,385

(22) Filed: Sep. 8, 2015

(65) Prior Publication Data

US 2016/0067874 A1 Mar. 10, 2016

(30) Foreign Application Priority Data

Sep. 9, 2014 (JP) ..... 2014-183371

(51) Int. Cl.

| | |
|---|---|
| ***B26D 1/14*** | (2006.01) |
| ***B26D 7/26*** | (2006.01) |
| ***B41J 11/70*** | (2006.01) |
| ***B26D 1/24*** | (2006.01) |
| ***B26D 5/08*** | (2006.01) |
| ***B26D 1/143*** | (2006.01) |
| ***B26D 1/157*** | (2006.01) |
| ***B26D 1/18*** | (2006.01) |

(52) U.S. Cl.

CPC ..... *B26D 7/2635* (2013.01); *B26D 1/141* (2013.01); *B26D 1/1435* (2013.01); *B26D 1/1575* (2013.01); *B26D 1/185* (2013.01); *B26D 1/245* (2013.01); *B26D 5/08* (2013.01); *B41J 11/706* (2013.01)

(58) Field of Classification Search

CPC ..... B26D 1/14; B26D 1/141; B26D 1/143; B26D 1/1435; B26D 1/157; B26D 1/1575; B26D 1/18; B26D 1/185; B26D 1/24; B26D 1/245; B26D 7/2628; B26D 7/2635; B41J 11/70; B41J 11/706

See application file for complete search history.

(56) References Cited

U.S. PATENT DOCUMENTS 5,881,623 A * 3/1999 Otani ..... B26D 1/245 83/455
2009/0226236 A1* 9/2009 Yamashita ..... B26D 1/185 400/621

FOREIGN PATENT DOCUMENTS

JP 06155372 A * 6/1994
JP H6-155372 A 6/1994

* cited by examiner

*Primary Examiner* — Kristal Feggins
*Assistant Examiner* — Kendrick Liu
(74) *Attorney, Agent, or Firm* — Fitzpatrick, Cella, Harper & Scinto

(57) ABSTRACT

A cutting apparatus comprises a cutting unit including a first blade member and a second blade member that cooperates with the first blade member in cutting an object, configured to cut the object by moving the object and at least one of the first and second blade members relative to each other in a cutting direction; and a changing unit configured to change a crossing angle between the first blade member and the second blade member during an operation of cutting the object, wherein the changing unit makes the crossing angle after the start of the cutting smaller than the crossing angle at the start of the cutting.

12 Claims, 13 Drawing Sheets

| ※MEDIA: CLOTH | | IMAGE | | WASTE RESULTING FROM BRAKEAGE OF RECEPTION LAYER |
|---|---|---|---|---|
| | | SOLID BLACK | NO PRINTING | |
| CROSSING ANGLE | 2.9° | 300 TO 400 TIMES | 300 TO 400 TIMES | SMALL AMOUNT |
| | 3.3° | 700 TO 800 TIMES | 900 TO 1,000 TIMES | LARGE AMOUNT |

NUMBER OF POSSIBLE CUTTINGS WITH CUTTER UNIT

FIG.11

CUTTING APPARATUS AND PRINTING APPARATUS

BACKGROUND OF THE INVENTION

Field of the Invention

The present invention relates to a cutting apparatus that cuts a cut medium and a printing apparatus with the cutting apparatus mounted therein.

Description of the Related Art

A cutting apparatus that cuts a cut medium (e.g., a print medium, such as a sheet) using a pair of blades is conventionally known. The cutting apparatus is mounted in, for example, a printing apparatus that cuts a rolled print medium, and is used as a device that cuts and separates a print medium with image data printed thereon into pages. As the print medium, a continuous sheet is used, such as ordinary paper, glossy paper, a vinyl medium, and a cloth medium. For cutting of the print medium, it is known that the angle of one of the blades to a blade cutting direction (crossing angle) is increased in order to allow the blades to appropriately bite into the sheet at the start of the cutting to enhance cutting performance.

However, the crossing angle at which the blades appropriately bite at the start of the cutting varies according to the type of the print medium. Thus, disadvantageously, for blades with a given crossing angle, when the type of the print medium to be cut is changed, the blades inappropriately bite at the start of the cutting.

To solve this problem, Japanese Patent Laid-Open No. H06-155372(1994) describes a configuration in which a fixing member that fixes a rotary blade is moved before the start of the cutting to change the angle of the rotary blade to the other blade (crossing angle) to enhance the cutting performance.

However, even for the same print medium, the crossing angle at which the blades appropriately bite at the start of the cutting (cutting performance) may be different from the crossing angle at which a cutting surface has high quality during the cutting (cutting quality).

When the cutting is performed with a large crossing angle set at the start of the cutting, the blades appropriately bite at the start of the cutting, but the cutting quality is degraded.

SUMMARY OF THE INVENTION

Thus, the present invention provides a cutting apparatus and a printing apparatus that allow blades to appropriately bite at the start of cutting while achieving high cutting quality.

Thus, a cutting apparatus comprises a cutting unit including a first blade member and a second blade member that cooperates with the first blade member in cutting an object, configured to cut the object by moving the object and at least one of the first and second blade members relative to each other in a cutting direction; and a changing unit configured to change a crossing angle between the first blade member and the second blade member during an operation of cutting the object, wherein the changing unit makes the crossing angle after the start of the cutting smaller than the crossing angle at the start of the cutting.

The aspect of the present invention allows the blades to appropriately bite into a cut medium at the start of cutting, while achieving high cutting quality.

Further features of the present invention will become apparent from the following description of exemplary embodiments (with reference to the attached drawings).

BRIEF DESCRIPTION OF THE DRAWINGS

FIG. 11 is a table indicating differences in cutting performance and cutting quality observed when the crossing angle is changed;

DESCRIPTION OF THE EMBODIMENTS

First Embodiment

Figure 1:
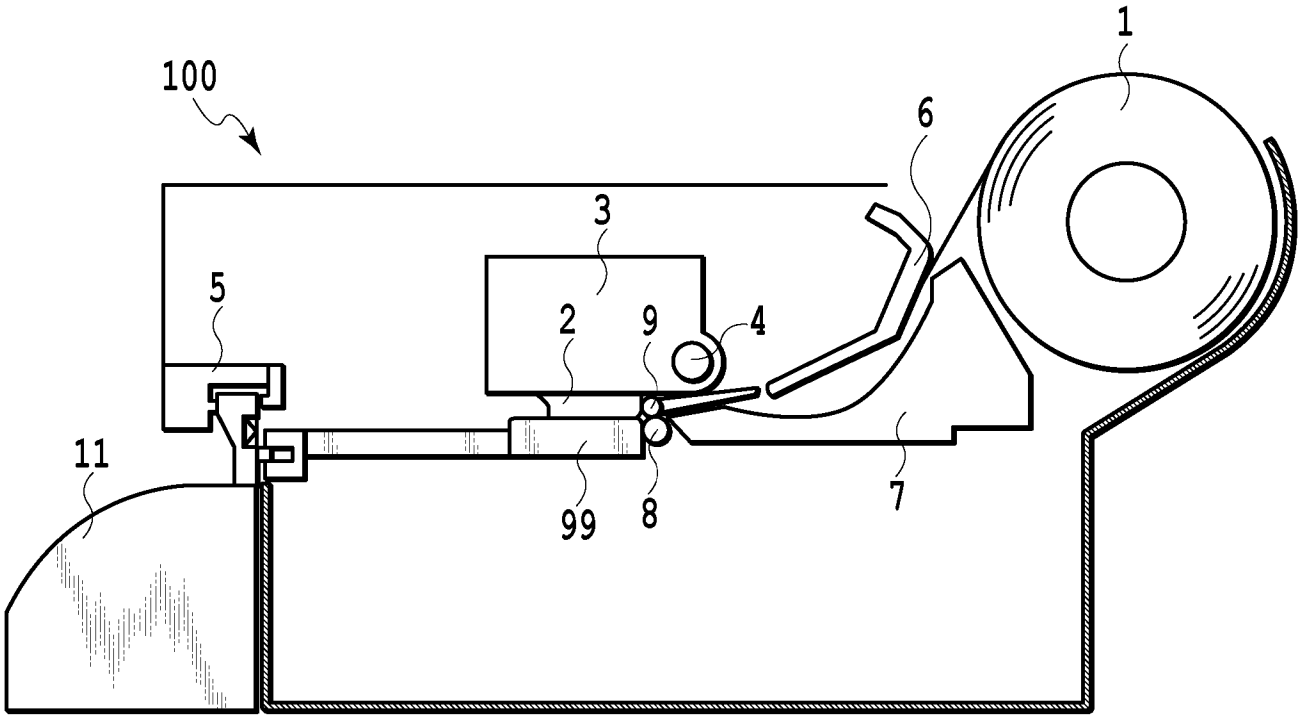
FIG. 1 is a schematic sectional view depicting an ink jet printing apparatus according to a first embodiment.

A first embodiment of the present invention will be described with reference to the drawings. The same reference numerals denote the same or corresponding components throughout the drawings.

FIG. 1 is a schematic sectional view depicting an ink jet printing apparatus according to the first embodiment of the present invention. With reference to FIG. 1, a general configuration of the ink jet printing apparatus according to the present embodiment will be described. Rolled paper 1 held in an ink jet printing apparatus 100 is fed downstream through a conveying path including an upper guide 6 and a lower guide 7. When a leading end of the rolled paper 1 reaches a nip portion between a conveying roller 8 and a pinch roller 9, the rolled paper 1 is sandwiched between the conveying roller 8 and the pinch roller 9 and conveyed onto a platen 99 (image printing section) arranged opposite to a print head 2.

The print head 2 ejects ink onto the rolled paper 1 conveyed to the image printing section to print an image on the rolled paper 1. The image printing section includes the print head 2, a carriage 3 on which the print head 2 is mounted, and the platen 99 arranged opposite to the print head 2. The carriage 3 is slidably supported by the main body of the ink jet printing apparatus 100 along a carriage shaft 4 and a guide rail (not depicted in the drawings) arranged parallel to each other. The carriage 3 is configured to be able to reciprocate. Printing is performed by reciprocating the carriage 3 with the print head 2 mounted thereon and allowing the print head 2 to eject ink onto the rolled paper 1.

In the image printing section, when an image is printed by moving the carriage 3 forward or backward to scan one line, the conveying roller 8 and the pinch roller 9 feeds the rolled paper 1 by a predetermined pitch in a conveying direction. The carriage 3 is then moved again to print the next line of image. A printed portion of the rolled paper 1 is conveyed toward a sheet discharging guide 11. Such an operation is repeated to print an image on the rolled paper 1. When the image printing ends, the rolled paper 1 is conveyed to a predetermined cutting position where the rolled paper 1 is cut using a cutting apparatus 5. The cut rolled paper 1 is discharged to the exterior of the ink jet printing apparatus 100 through the sheet discharging guide 11.

Figure 2:
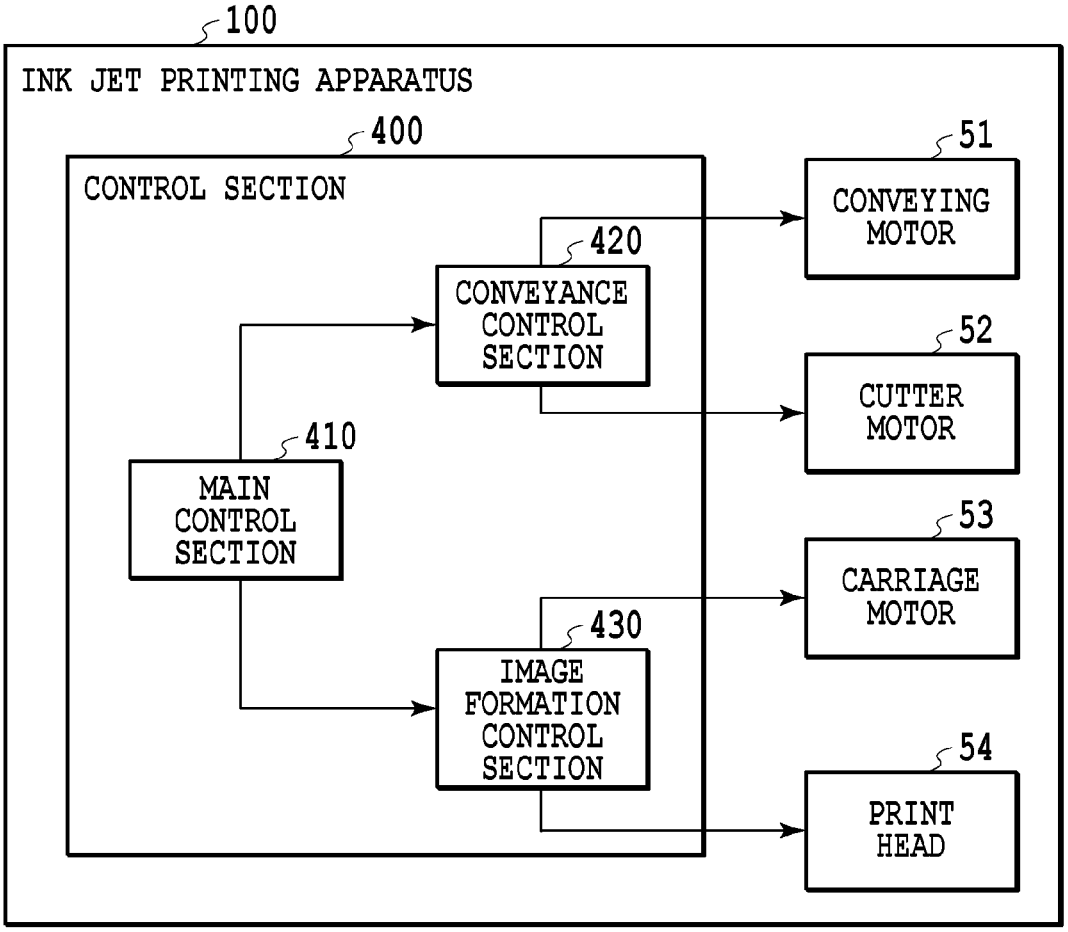
FIG. 2 is a schematic block diagram depicting an embodiment of a control configuration.

FIG. 2 is a schematic block diagram depicting an embodiment of a control configuration of the ink jet printing apparatus 100. With reference to FIG. 2, the control configuration according to the present invention will be described in brief. A control section 400 is provided on the ink jet printing apparatus 100. The control section 400 achieves control of a conveying motor 51, a cutter motor 52, a carriage motor 53, and a print head 54. The control section 400 also includes a CPU, a ROM, a RAM, and a motor driver not depicted in the drawings, and further includes a main control section 410, a conveyance control section 420, and an image formation control section 430.

The main control section 410 gives instructions to the conveyance control section 420 and the image formation control section 430. Based on determination by the main control section 410, the conveyance control section 420 drives the conveying motor 51 to operate conveying devices such as the conveying roller 8 to convey the rolled paper 1, and drives the cutter motor 52 to cut the rolled paper 1. The image formation control section 430 allows the carriage motor 53 and the print head 2 to cooperate with each other in forming an image at an appropriate position on the rolled paper 1.

Figure 3:
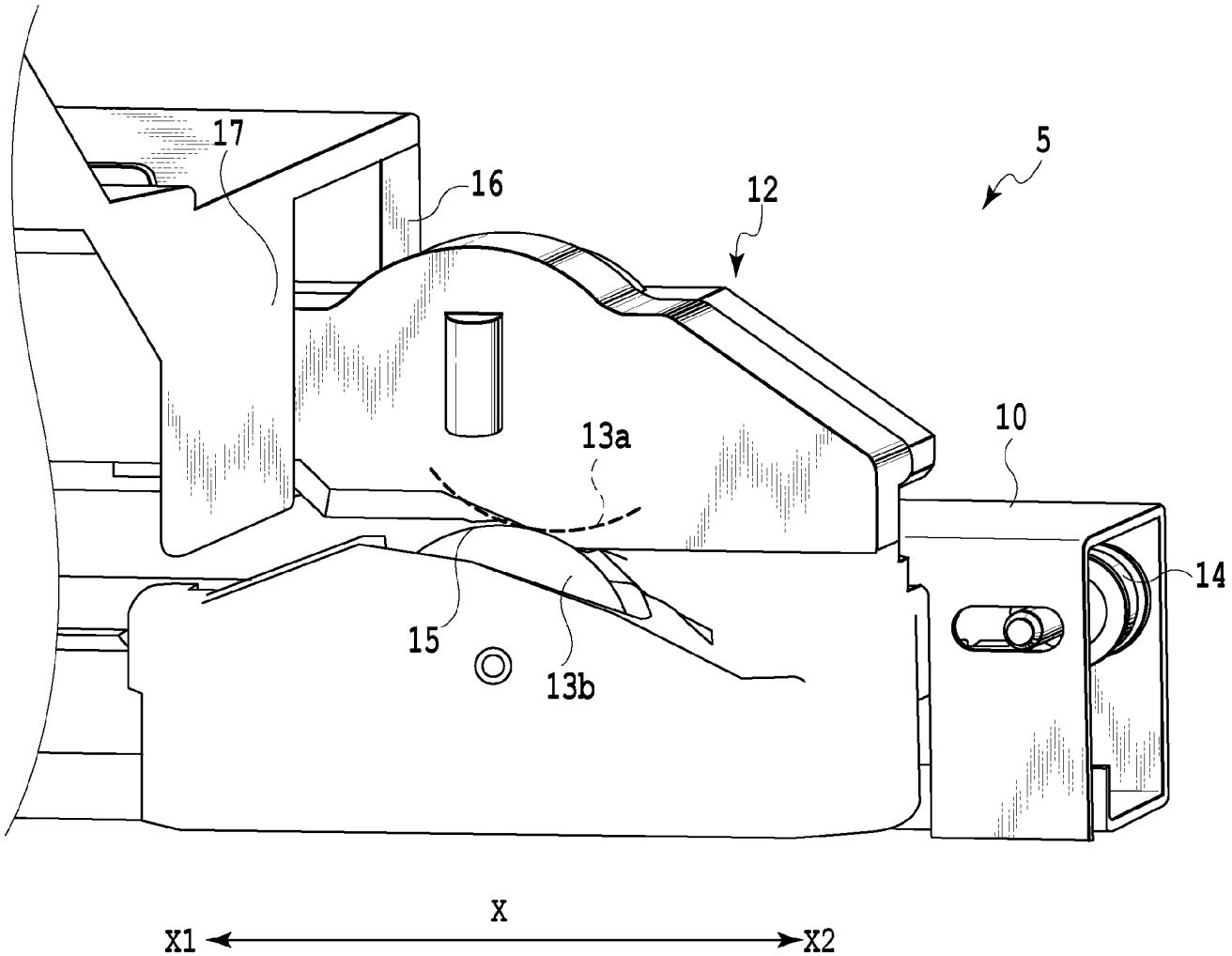
FIG. 3 is a perspective view depicting a cutting apparatus according to the first embodiment.
Figure 4:
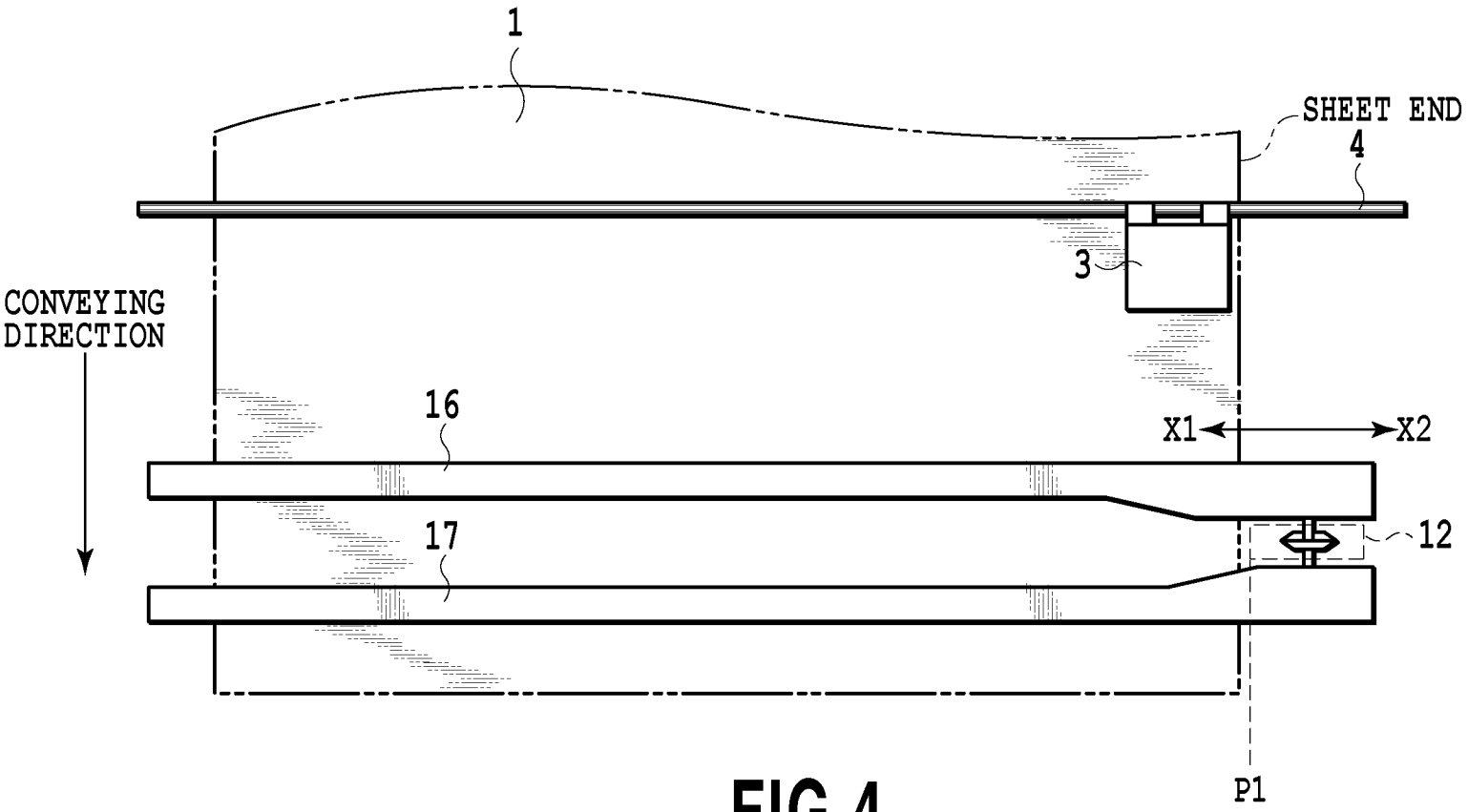
FIG. 4 is a top view of an ink jet printing apparatus according to the first embodiment.
Figure 5:
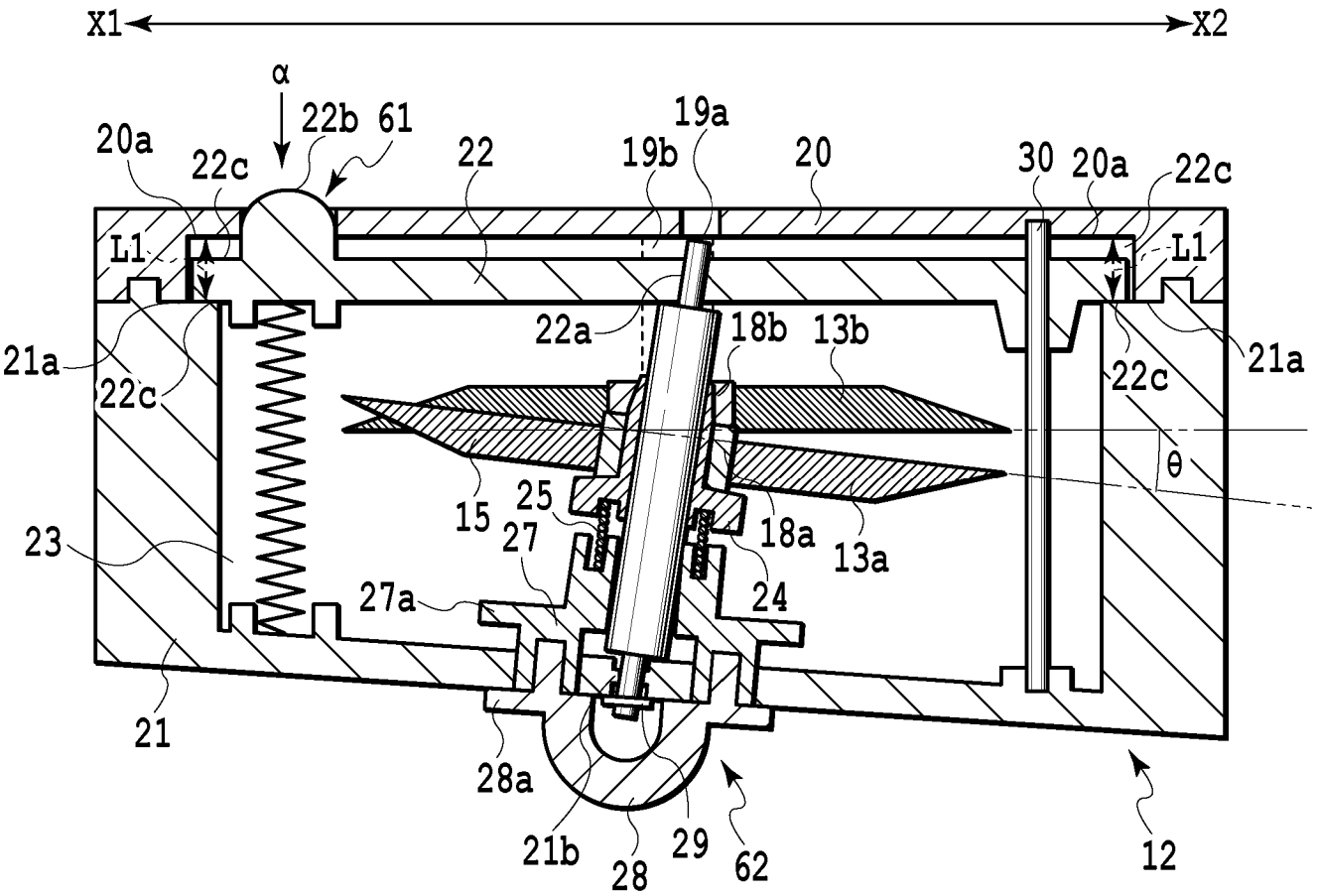
FIG. 5 is a schematic sectional view of a cutter unit according to the first embodiment as seen from above.
Figure 6:
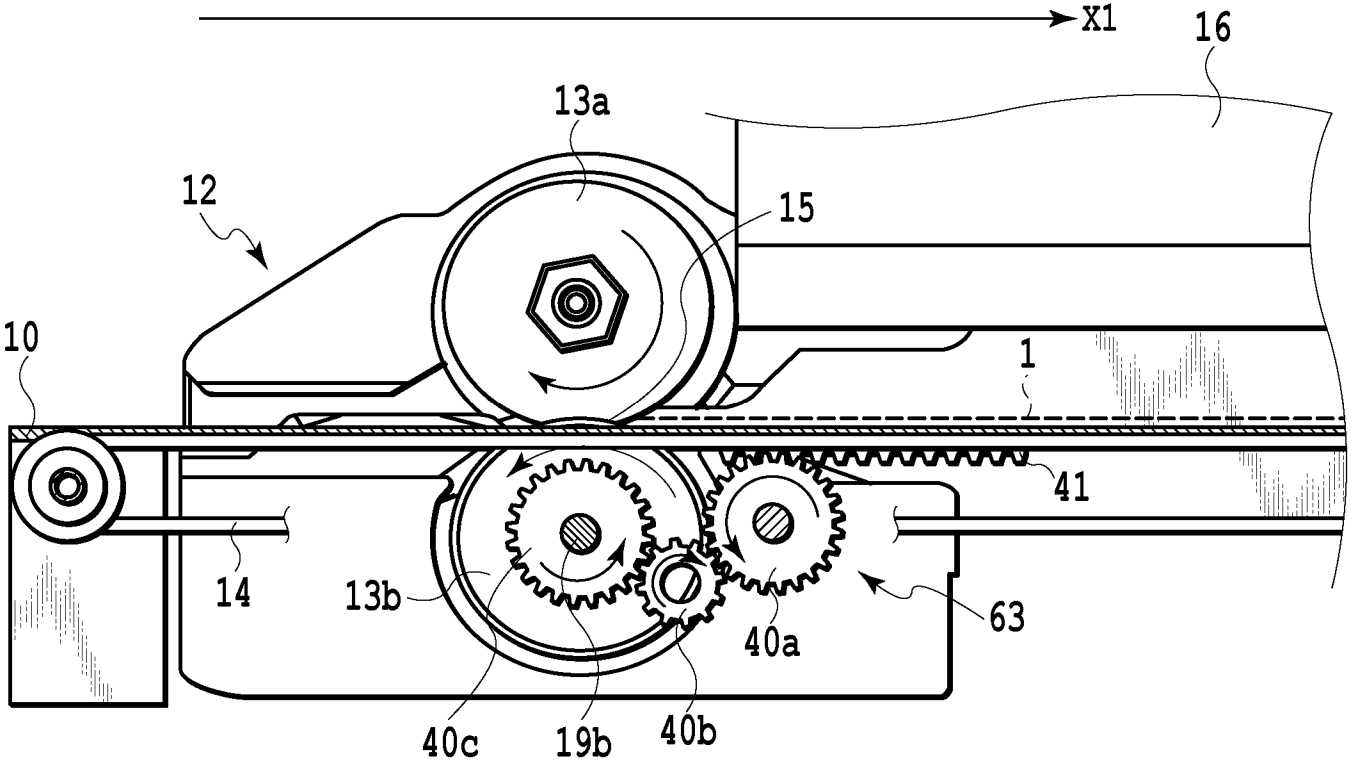
FIG. 6 is a schematic sectional view of the cutter unit according to the first embodiment as seen from behind.

FIG. 3 is a perspective view depicting the cutting apparatus according to the present invention. FIG. 4 is a top view of the ink jet printing apparatus according to the present invention. FIG. 5 is a schematic sectional view of a cutter unit according to the present invention as seen from above. FIG. 6 is a schematic sectional view of the cutter unit according to the present invention as seen from behind, depicting a peripheral speed changing member that rotates a lower movable blade when the cutter unit is in a cutting start point position.

Now, the cutting apparatus according to the present invention will be described with reference to FIG. 3, FIG. 4, FIG. 5, and FIG. 6. A cutting apparatus 5 has a cutter unit 12, a guide rail 10, and a belt 14. The guide rail 10 is configured to guide the cutter unit 12 in a direction orthogonal to the conveying direction of the rolled paper 1. The cutter unit 12 can be reciprocated along the guide rail 10 in the direction X1 and direction X2 of arrow X by a driving force transmitted from the cutter motor 52, which is a driving section, via the belt 14.

The cutter unit 12 stands by in a standby position P1 (see FIG. 4) where the cutter unit 12 is away from an end of the rolled paper 1 while image formation is being performed on the rolled paper 1. When the rolled paper 1 is cut, the cutter unit 12 moves in the cutting direction X1, which is the direction for cutting, from the standby position P1 to cut the rolled paper 1 (object). After the rolled paper 1 is cut, the cutter unit 12 moves in the direction X2 without performing a cutting operation and stands by in the standby position P1 until the next cutting operation.

As depicted in FIG. 5 and FIG. 6, the cutter unit 12 includes an upper movable blade (blade member) 13*a*, a lower movable blade (blade member) 13*b*, a crossing angle changing member 61, a pressing force changing member 62, and a peripheral speed changing member 63. The upper movable blade 13*a* is a rotatable disc-like (circular) blade disposed above a surface of the rolled paper 1 on which an image is formed and including a peripheral blade. The lower movable blade 13*b* is rotatable disc-like circular blade including a peripheral blade; the lower movable blade 13*b* is disposed below a back surface of the rolled paper 1 that is opposite to the surface on which the image is formed, and cooperates with the upper movable blade 13*a* in cutting the object. The blade of the lower movable blade 13*b* has a surface substantially parallel to the cutting direction. On the other hand, the blade of the upper movable blade 13*a* has a surface inclined to the cutting direction and subtends a predetermined angle θ (crossing angle θ) to the cutting direction X1.

Specifically, a standby position P1 side of the upper movable blade 13*a* is disposed on a downstream side with respect to the lower movable blade 13*b* in the conveying direction of the rolled paper 1. The side of the upper movable blade 13*a* opposite to the standby position P1 side is partly disposed on an upstream side with respect to the lower movable blade 13*b* in the conveying direction of the rolled paper 1. The upper movable blade 13*a* is pressed against the lower movable blade 13*b* at a predetermined angle θ (crossing angle θ) to the cutting direction X1. The upper movable blade 13*a* thus comes into point contact with the lower movable blade 13*b* and is rotatably held. In other words, the upper movable blade 13*a* is pressed against the lower movable blade 13*b* at the predetermined angle θ (crossing angle θ). The contact point between the upper movable blade 13*a* and the lower movable blade 13*b* corresponds to a cutting point 15. The upper movable blade 13*a* and the lower movable blade 13*b* rotate while in contact with each other at the cutting point 15. Consequently, the cutter unit 12 moves in the cutting direction X1 with the rolled paper 1 held, cutting the rolled paper 1.

When the rolled paper 1 is cut, the cutter unit 12 moves in the cutting direction X1 to rotate the upper movable blade 13*a* and the lower movable blade 13*b* in a direction in which the rolled paper 1 is drawn into the cutting point 15, and moves in the direction X1 as depicted in FIG. 6. A bearing 18*a* and a bearing 18*b* are fixed with an adhesive or the like to the vicinities of the centers of rotation of the upper movable blade 13*a* and the lower movable blade 13*b*, respectively. The bearings reduce rotating loads on the upper movable blade 13*a* and the lower movable blade 13*b*. The upper movable blade 13*a* and the lower movable blade 13*b* rotate around an upper movable blade rotating shaft 19*a* and a lower movable blade rotating shaft 19*b*, respectively, via the bearings.

As depicted in FIG. 5, the crossing angle changing member 61 includes an upstream side holding portion 20, a downstream side holding portion 21, a slide member 22, a slide pressing spring 23, and a slide rail shaft 30. The crossing angle changing member 61 allows the crossing angle θ of the upper movable blade 13*a* to be changed. A groove portion 22*a* is formed in the slide member 22 to pivotally support one side of the upper movable blade rotating shaft 19*a*. A groove portion 21*b* is formed in the downstream side holding portion 21 to pivotally support the other side of the upper movable blade rotating shaft 19*a*.

That is, the groove portion 22*a* formed in the slide member 22 and the groove portion 21*b* formed in the downstream side holding portion 21 pivotally support the upper movable blade rotating shaft 19*a*. The groove portion 22*a* in the slide member 22 is arranged behind and at a predetermined distance from the groove portion 21*b* in the downstream side holding portion 21 such that the upper movable blade rotating shaft 19*a* is inclined to a direction orthogonal to the cutting direction X1. Thus, the upper movable blade 13*a* is inclined at the predetermined angle (crossing angle) θ to the cutting direction X1. That is, the upper movable blade rotating shaft 19*a*, the groove portion 21*b* in the downstream side holding portion 21, and the groove portion 22*a* in the slide member 22 set the crossing angle θ.

A thrust suppressing portion 29 is attached to an end of the downstream side holding portion 21 of the upper movable blade rotating shaft 19*a* to prevent the upper movable blade rotating shaft 19*a* from slipping out from the downstream side holding portion 21. The slide rail shaft 30 is pivotally supported in a direction substantially orthogonal to the cutting direction X1 by the upstream side holding portion 20 and the downstream side holding portion 21. The slide member 22 includes an abutting contact portion 22*c* arranged in a slide area L1 sandwiched between a retaining portion 20*a* of the upstream side holding portion 20 and a sliding suppressing portion 21*a* of the downstream side holding portion 21.

In the above-described arrangement, the slide member 22 can slide on the slide rail shaft 30 within the slide area L1. The slide member 22 is biased, by the slide pressing spring 23 held by the slide member 22, in a direction in which the slide member 22 presses the abutting contact portion 22*c* against the retaining portion 20*a* of the upstream side holding portion 20. The slide member 22 also has a contact portion 22*b* that partly protrudes from the upstream side holding portion 20 and in which the protruding part is shaped like a circular arc at a leading end of thereof. Pushing in the contact portion 22*b* in the direction of arrow a moves the slide member 22 within the slide area L1.

When the slide member 22 moves within the slide area L1, the upper movable blade rotating shaft 19*a* is tilted around the groove portion 21*b* in the downstream side holding portion 21 so as to change the inclination of the upper movable blade rotating shaft 19*a* to the direction orthogonal to the cutting direction X1. This changes the crossing angle θ of the upper movable blade 13*a*. When the cutter unit 12 reciprocates, the upstream side holding portion 20 and the downstream side holding portion 21 are guided with respect to the guide rail 10 depicted in FIG. 3.

When the abutting contact portion 22*c* of the slide member 22 maximally approaches the sliding preventing portion 21*a* of the downstream side holding portion 21 (as depicted in FIG. 5), the crossing angle θ is maximized. In contrast, the abutting contact portion 22*c* of the slide member 22 maximally approaches the retaining portion 20*a* of the upstream side holding portion 20, the crossing angle θ is minimized. Thus, moving the slide member 22 enables a change in the crossing angle, which is the angle of the upper movable blade 13*a* with respect to the cutting direction X1. In other words, while the rolled paper 1 is being cut, moving the slide member 22 enables the crossing angle θ to be changed even while the rolled paper 1 is being cut.

The crossing angle θ is an element related to a cutting property, and an increase in crossing angle θ allows the blades to appropriately bite into a sheet at the start of cutting (cutting performance). However, an increase in crossing angle θ leads to degraded cutting quality such as a large amount of paper dust from a cutting surface of the rolled paper 1 being cut or deteriorated durability of the blades. Thus, the quality of cutting surface of the paper (cutting quality) is enhanced by reducing the crossing angle at a predetermined timing after the start of the cutting.

The pressing force changing member 62 includes a spring holder 24, a pressing spring 25, an external holder 27, and a pressing device 28. The pressing force changing member 62 enables a change in a pressing force F exerted on the lower movable blade 13*b* by the upper movable blade 13*a*. The spring holder 24 is attached around the upper movable blade rotating shaft 19*a* so as to contact an inner ring portion of the bearing 18*a* of the upper movable blade 13*a*. The pressing spring 25 is held by the external holder at one end of the pressing spring 25 and by the spring holder 24 at the other end of the pressing spring 25. The pressing spring 25 presses the upper movable blade 13*a* against the lower movable blade 13*b* via the spring holder 24 and the bearing 18*a* of the upper movable blade 13*a*.

The external holder 27 is coupled to the pressing member 28 on a side thereof opposite to a side thereof that holds the pressing spring 25. The downstream side holding portion 21 is sandwiched between a thrust suppressing portion 27*a* of the external holder 27*a* and a thrust suppressing portion 28*a* of the pressing member 28. The external holder 27 is slidable with respect to the downstream side holding portion 21. The external holder 27 moves via the pressing member 28 to change an operating length of the pressing spring 25, thus changing the pressing force F exerted on the lower movable blade 13*b* by the upper movable blade 13*a*.

When the thrust suppressing portion 28*a* of the pressing member 28 maximally approaches the downstream side holding portion 21 (as depicted in FIG. 5), the pressing force F exerted on the lower movable blade 13*b* by the upper movable blade 13*a* is maximized. In contrast, when the thrust suppressing portion 27*a* of the external holder 27 maximally approaches the downstream side holding portion 21, the pressing force F exerted on the lower movable blade 13*b* by the upper movable blade 13*a* is minimized. Thus, moving the external holder 27 via the pressing member 28 enables a change in the pressing force F exerted on the lower movable blade 13*b* by the upper movable blade 13*a*. In other words, moving the external holder 27 via the pressing member 28 during the cutting of the rolled paper 1 enables a change in the pressing force F exerted on the lower movable blade 13*b* by the upper movable blade 13*a* even during the cutting of the rolled paper 1.

The pressing force F is an element related to the cutting property. An increase in pressing force F allows suppression of inappropriate cutting resulting from separation of the blades caused by cutting resistance from the sheet; the inappropriate cutting is likely to occur near the end of the rolled paper 1 at the start of the cutting. However, increasing the pressing force F causes the blades to be worn off, degrading the durability of the upper movable blade 13*a* and the lower movable blade 13*b*. Thus, at a predetermined timing after the start of the cutting, the pressing force is reduced to suppress degraded durability of the blades.

As depicted in FIG. 6, the peripheral speed changing member 63 is provided in the cutter unit 12 and includes a rotation input gear 40*a*, a driven gear 40*b*, and a rotary blade rotating gear 40*c*. In the peripheral speed changing member 63, the rotation input gear 40*a* meshes with a rack member 41 provided on the guide rail 10 to move relative to the guide rail 10, thus forcibly rotating the lower movable blade 13*b*. The rotation input gear 40*a* meshes with the rack member 41 provided on the guide rail 10 and is thus forcibly rotated in conjunction with movement of the cutter unit 12.

The driven gear 40*b* transmits rotation of the rotation input gear 40*a* to the rotary blade rotating gear 40*c*. The rotary blade rotating gear 40*c* is integrally attached to the lower movable blade 13*b* such that the lower movable blade rotating shaft 19*b* corresponds to a central axis, so that the rotary blade rotating gear 40*c* can rotate integrally with the lower movable blade 13*b*. Forcibly rotating the rotary blade rotating gear 40*c* also rotates the lower movable blade 13*b*. In an area where the rack member 41 is not provided, the rotary blade rotating gear 40*c* does not mesh with the rack member 41 and thus does not rotate. That is, within a movement area of the cutter unit 12, different areas are provided: the area where the rotation input gear 40*a* meshes with the rack member 41 and the area where the rotation input gear 40*a* does not mesh with the rack member 41. Consequently, the peripheral speed changing member 63 enables switching between an area where the lower movable blade 13*b* is forcibly rotated and an area where the lower movable blade 13*b* is not rotated.

A moving speed of the cutter unit 12 is represented as a cutting speed V1. A peripheral speed of the lower movable blade 13*b* is represented as a peripheral speed V2. As the cutter unit 12 moves, the rotation input gear 40*a*, the driven gear 40*b*, and the rotary blade rotating gear 40*c* are forcibly rotated at a peripheral speed equal to the cutting speed V1 in the direction of an arrow in FIG. 6. Rotation of the rotary blade rotating gear 40*c* rotates the lower movable blade 13*b*, which rotates integrally with the rotary blade rotating gear 40*c*.

The pitch circle diameter of the rotary blade rotating gear 40*c*<the diameter of the lower movable blade 13*b*, and thus, the peripheral speed V2 of the lower movable blade 13*b* is higher than the cutting speed V1. In the present embodiment, the lower movable blade 13*b* has a diameter of 24 mm, and the rotary blade rotating gear 40*c* has a pitch circle diameter of 12 mm. Thus, the peripheral speed V2 of the lower movable blade 13*b* is approximately 2×V1, that is, approximately twice as high as the cutting speed V1, that is, the moving speed of the cutter unit 12. The speed of a cutting edge relative to the rolled paper 1 is approximately 2×V1, which is equal to the peripheral speed V2 of the lower movable blade 13*b*.

On the other hand, in the area where the rack member 41 is not provided, the lower movable blade 13*b* is not rotated by the rack member 41. However, when the rolled paper 1 is cut, the upper movable blade 13*a* and the lower movable blade 13*b* are moved at the cutting speed V1 equal to the moving speed of the cutter unit 12, while cutting the rolled paper 1. Thus, the upper movable blade 13*a* and the lower movable blade 13*b* rotate as a result of a frictional force between the rolled paper 1 and the blades. Consequently, when the rolled paper 1 is cut in the area where the rack member 41 is not provided, the upper movable blade 13*a* and the lower movable blade 13*b* rotate at the peripheral speed V2 approximately equal to the cutting speed V1 corresponding to the moving speed of the cutter unit 12. The speed of the cutting edge relative to the rolled paper 1 is approximately equal to the cutting speed V1, which is in turn equal to the peripheral speed V2 of the lower movable blade 13*b*.

On the other hand, when the rolled paper 1 is not being cut in the area where the rack member 41 is not provided, no force that rotates the lower movable blade 13*b* is obtained, and thus, the peripheral speed V2 of the lower movable blade 13*b* is zero. Consequently, the upper movable blade 13*a* and the lower movable blade 13*b* do not rotate. The speed of the cutting edge relative to the rolled paper 1 is zero, which is equal to the peripheral speed V2 of the lower movable blade 13*b*. The case where the rolled paper 1 is not being cut occurs during a moving operation in the cutting direction X1 after the cutting of the rolled paper 1 ends and during a moving operation in the direction X2 when the cutter unit 12 returns to the standby position P1.

While the rolled paper 1 is not being cut, the upper movable blade 13*a* is rotated in conjunction with rotation of the lower movable blade 13*b* as a result of friction between the upper movable blade 13*a* and the lower movable blade 13*b*. The upper movable blade 13*a* rotates at a speed lower than the peripheral speed V2 of the lower movable blade 13*b*. As described above, when a cutting path for the rolled paper 1 includes different parts: the part where the rack member 41 is provided and the part where the rack member 41 is not provided, the peripheral speed V2 of the lower movable blade 13*b* can be switched during cutting of the rolled paper 1.

In cutting using a disc-like circular blade, the peripheral speed, which is equal to the speed of the cutting edge relative to the rolled paper 1, is an element related to the cutting property. An increase in peripheral speed allows the blades to appropriately bite into the sheet. On the other hand, increasing the peripheral speed leads to degraded cutting quality such as a large amount of paper dust from the cutting surface or degraded durability of the blades. When the peripheral speed V2 of the lower movable blade 13*b* is increased with respect to the moving speed, an effect is enhanced which causes the rolled paper 1 to be drawn into the cutting point 15 between the upper movable blade 13*a* and the lower movable blade 13*b*. This is effective for enabling the blades to more appropriately bite into the sheet.

Figure 7:
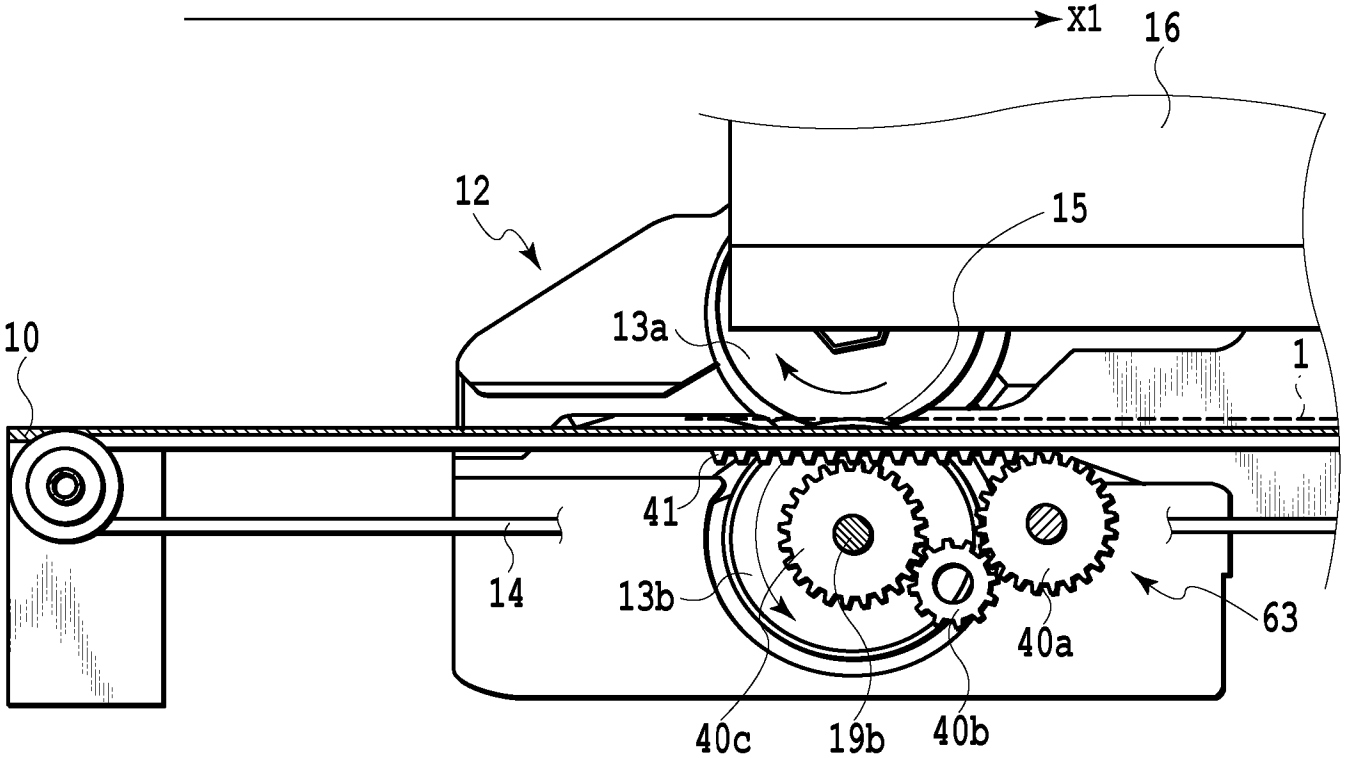
FIG. 7 is a schematic sectional view of the cutter unit according to the first embodiment as seen from behind during cutting.
Figure 8:
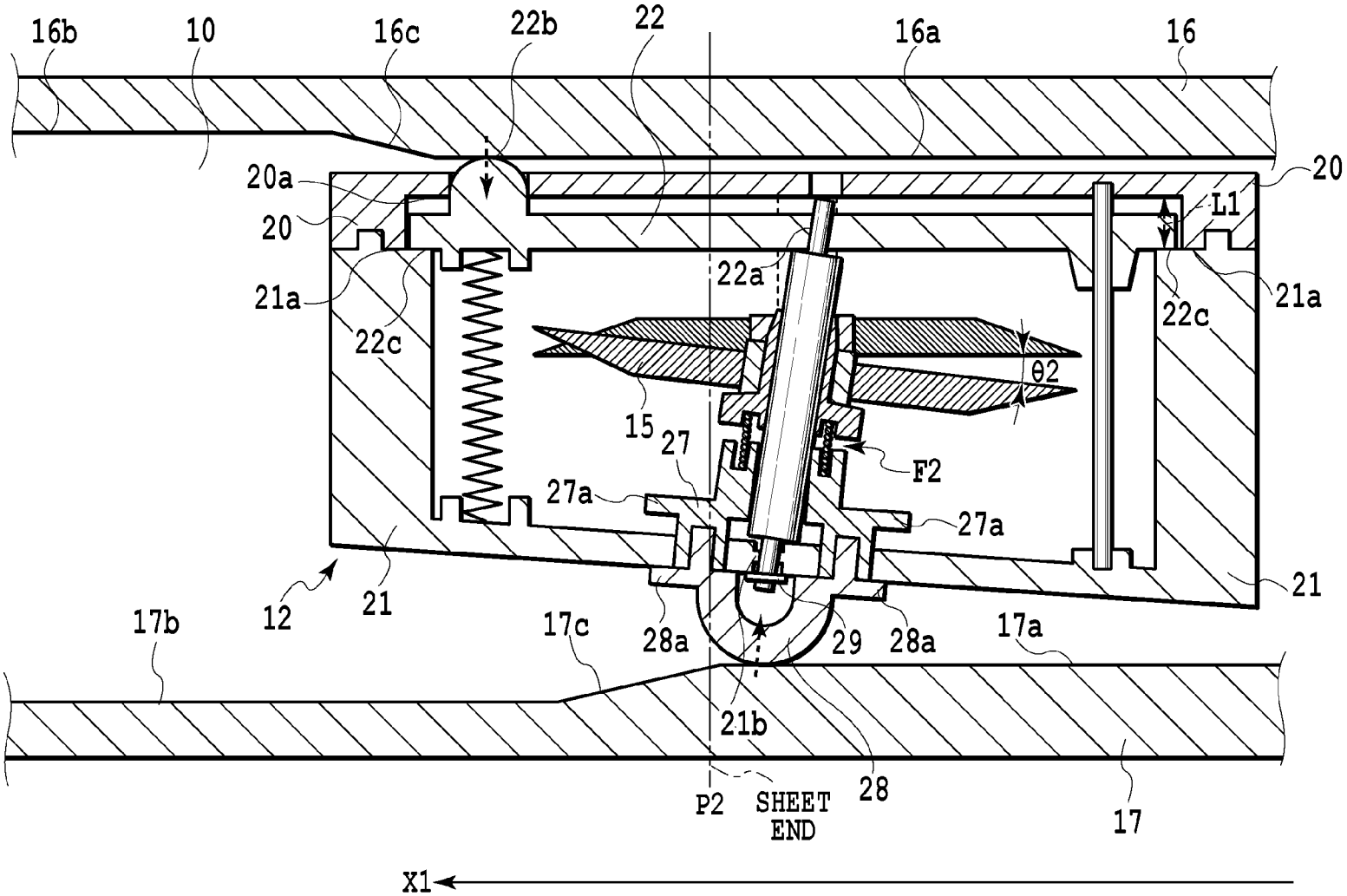
FIG. 8 is a schematic sectional view of the cutter unit according to the first embodiment as seen from above.
Figure 9:
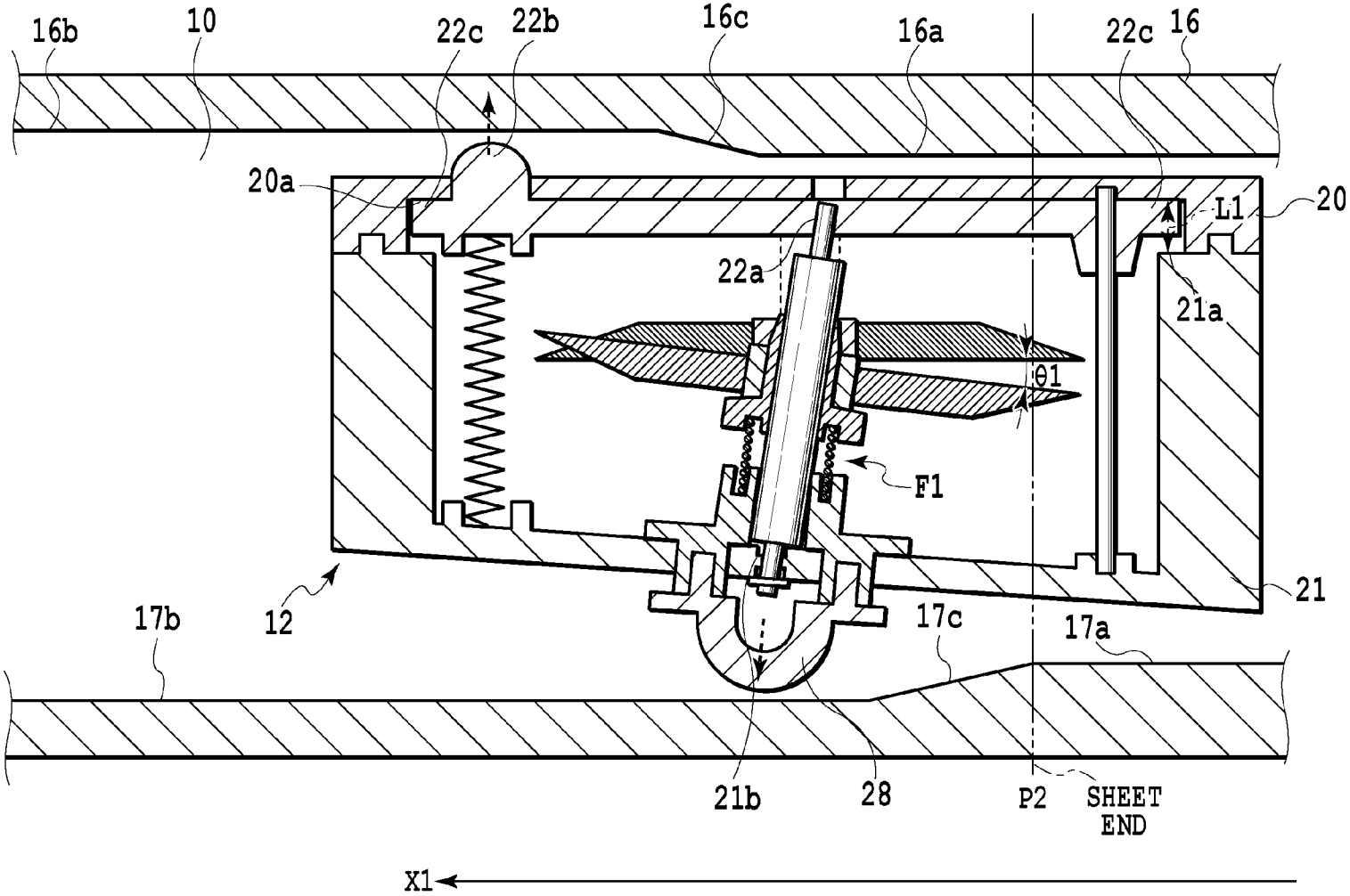
FIG. 9 is a schematic sectional view of the cutter unit according to the first embodiment as seen from above during cutting.

FIG. 7 is a schematic sectional view of the cutter unit 12 according to the present invention during cutting as seen from behind, depicting the peripheral speed changing member rotating the lower movable blade 13*b* that is in the position of cutting after the cutter unit 12 in the state illustrated in FIG. 6 has further moved in the cutting direction X1. FIG. 8 is a schematic sectional view of the cutter unit according to the present invention in a cutting start point position as seen from above. FIG. 9 is a schematic sectional view depicting a state where the cutter unit in the state illustrated in FIG. 8 has further moved in the cutting direction X1 and where the cutter unit according to the present invention is in the position of cutting, as seen from above.

Now, with reference to FIG. 6, FIG. 7, FIG. 8, and FIG. 9, the operation of the cutter unit 12 changing cutting conditions during cutting by the cutting apparatus according to the present invention will be described in conjunction with effects of an upstream support member 16, effects of a downstream support member 17, and effects of the rack member 41.

The upstream support member changes the crossing angle θ of the upper movable blade 13*a* to the lower movable blade 13*b*. As depicted in FIG. 7, the upstream support member 16 is arranged above a surface of the rolled paper 1 on which the image is printed. The upstream support member 16 pushes the slide member 22 via the contact portion 22*b* of the cutter unit 12 to change the position of the slide member 22, thus changing the crossing angle θ of the upper movable blade 13*a* to the lower movable blade 13*b*. As depicted in FIG. 8, the upstream support member 16 includes a first flat surface (protruding portion) 16*a* that is a surface protruding in the conveying direction, which is orthogonal to the cutting direction X1, a second flat surface 16*b* that is a surface retracted at a predetermined distance from the first flat surface 16*a* in the conveying direction, and a slope portion 16*c* that joins the first flat surface 16*a* and the second flat surface 16*b* together.

The first flat surface 16*a* protrudes to the degree that the contact portion 22*b* is pushed to bring the abutting contact portion 22*c* of the slide member 22 nearly into contact with the sliding suppressing portion of the downstream side holding portion 21. As depicted in FIG. 8, when the contact portion 22*b* is in a position corresponding to the first flat surface 16*a* in the cutting direction, that is, when the cutter unit 12 is in a position where the contact portion 22*b* is pushed in by the first flat surface 16*a*, the crossing angle θ of the upper movable blade 13*a* to the cutting direction X1 is maximized (crossing angle θ=θ2). At a crossing angle θ=θ2 where the crossing angle θ is maximized, the blades appropriately bite into the sheet. This prevents a situation where, when the cutting point 15 between the upper movable blade 13*a* and the lower movable blade 13*b* passes through a cutting start point P2 for the rolled paper 1, the blades fail to bite into the sheet, which is then deformed.

The second flat surface 16*b* is provided on a traveling direction side (opposite to the standby position P1) in the cutting direction during cutting with respect to the first flat surface 16*a*. The second flat surface 16*b* is retracted to the degree that, with the abutting contact portion 22*c* of the slide member 22 in contact with the retaining portion 20*a* of the upstream side holding portion 20, the contact portion 22*b* of the slide member 22 does not contact the second flat surface 16*b*. That is, as depicted in FIG. 9, when the contact portion 22*b* is in the position corresponding to the second flat surface 16*b* in the cutting direction, the cutter unit 12 is not pushed in because the contact portion 22*b* of the slide member 22 does not contact the second flat surface 16*b*.

At this time, the spring bias force of the slide pressing spring 23 brings the abutting contact portion 22*c* of the slide member 22 into contact with the retaining portion 20*a* of the upstream side holding portion 20. Thus, the crossing angle θ of the upper movable blade 13*a* to the lower movable blade 13*b* is minimized (crossing angle θ=θ1). At a crossing angle θ=θ1 where the crossing angle θ is minimized, cutting can be achieved such that the cutting surface of the rolled paper 1 being cut exhibits high quality, suppressing possible paper dust during the cutting.

In connection with movement of the cutter unit 12 in the cutting direction X1, the first flat surface 16*a* is arranged such that at least when the cutting point 15 of the cutter unit 12 is positioned at the cutting start point P2 where the cutting of the rolled paper 1 is started, the contact portion 22*b* comes into contact with the first flat surface 16*a*. Specifically, the first flat surface 16*a* is formed to extend from a position closer to the standby position P1 than the cutting start point P2 in the cutting direction to a position on the traveling direction side in the cutting direction with respect to the end of the rolled paper 1. Thus, the contact portion 22*b* remains in contact with the first flat surface 16*a* until the cutting point 15 reaches the cutting start point P2.

The slope portion 16*c* is arranged so as to extend from a position to which, during the cutting, the cutting point 15 of the cutter unit 12 moves a predetermined distance after passing through the cutting start point P2. In this regard, the predetermined distance is determined with a variation in the sheet end position of the rolled paper 1 taken into account and, for example, corresponds to one rotation of the upper movable blade 13*a* following the start of the cutting of the rolled paper 1. In the present embodiment, the predetermined distance is 5 to 80 mm from the cutting start point P2.

The slope portion 16*c* smoothly joins the first flat surface 16*a* and the second flat surface 16*b* together to suppress a rapid change in the position of the slide member 22, thus restraining damage to the upper movable blade 13*a* and the lower movable blade 13*b* caused by a rapid change in the crossing angle θ of the upper movable blade 13*a*. The slope portion 16*c* may be a flat surface or a curved surface as long as the slope portion 16*c* allows the first flat surface 16*a* and the second flat surface 16*b* to be smoothly joined together. In the above description, the second flat surface 16*b* is retracted to the degree that, with the abutting contact portion 22*c* of the slide member 22 in contact with the retaining portion 20*a* of the upstream side holding portion 20, the contact portion 22*b* of the slide member 22 does not contact the second flat surface 16*b*. However, the present embodiment is not limited to this configuration. For example, the second flat surface 16*b* may be positioned to the degree that the abutting contact portion 22*c* of the slide member 22 contacts the second flat surface 16*b*, specifically, to the degree that the abutting contact portion 22*c* of the slide member 22 contacts the retaining portion 20*a* of the upstream side holding portion 20.

As described above, in the present embodiment, the crossing angle changing member 61 and the upstream support member 16 provided in the cutting apparatus 5 enable the crossing angle θ of the upper movable blade 13*a* to be changed while the rolled paper 1 is being cut. When the cutting of the rolled paper 1 is started (cutting start point P2), the crossing angle θ of the upper movable blade 13*a* is set to a large value because the blades have difficulty biting into the sheet. This allows the blades to appropriately bite into the sheet to prevent a situation where the sheet starts to be deformed at the position of abutting contact with the blades and is thus pushed in the cutting direction X1, resulting in inappropriate cutting. On the other hand, in the area corresponding to a time following the start of the cutting, the inappropriate cutting resulting from the pushing of the sheet in the cutting direction X1 is unlikely to occur. Thus, the crossing angle θ of the upper movable blade 13*a* is set to a small value to suppress degradation of the cutting quality such as a large amount of paper dust from the cutting surface or degradation of durability of the blades.

As described above, the cutting apparatus of the present embodiment includes the crossing angle changing member 61 that changes the crossing angle θ, which is the angle of the upper movable blade 13*a* to the lower movable blade 13*b*, while the cut medium is being cut. In the crossing angle changing member 61, the upstream support member 16 includes the first flat surface 16*a* and the second flat surface 16*b*. Before the cutter unit 12 performs cutting and when the cutter unit 12 is in the cutting start point P2, the slide member 22 contacts the first flat surface 16*a* and is pushed downstream in the conveying direction to tilt the upper movable blade rotating shaft 19*a*, increasing the crossing angle θ.

Thus, at the start of the cutting (initial cutting operation), the blades appropriately bite into the sheet to allow the cutting performance to be enhanced. During the cutting, the slide member 22 reaches the second flat surface 16*b* through the slope portion 16*c* and is slid toward the upstream side holding portion 20. Consequently, the crossing angle θ decreases to allow the quality of the cutting surface to be restrained from being degraded.

In the present embodiment, the first flat surface 16*a* extends from the position corresponding to a time preceding the start of the cutting to the position where the cutting point 15 of the cutter unit 12 reaches the cutting start point P2. However, the present embodiment is not limited to this configuration. For example, the first flat surface 16*a* may be formed at a position corresponding to a time immediately before the end of the cutting to increase the crossing angle θ to enhance the cutting performance. This configuration prevents a situation where the sheet above the sheet discharge guide 11 falls obliquely starting with a cutting start side of the sheet, to raise an uncut part of the sheet, resulting in inappropriate cutting. Alternatively, a flat surface with a protruding distance equivalent to the protruding distance of the first flat surface 16*a* may be provided in two areas including an area corresponding to an initial period of the cutting and an area corresponding to a time immediately before the end of the cutting. Thus, the protruding distance of the upstream support member 16 and the location of the upstream support member 16 are not limited to those in the present embodiment but may be freely set in order both to enhance the cutting performance and to ensure the cutting quality.

The downstream support member changes the pressing force exerted on the lower movable blade 13*b* by the upper movable blade 13*a*. The downstream support member 17 is arranged above the surface of the rolled paper 1 on which the image is printed. The downstream support member 17 controls the position of the external holder 27 via the pressing member 28 of the cutter unit 12 to change the pressing force exerted on the lower movable blade 13*b* by the upper movable blade 13*a* as depicted in FIG. 8. The downstream support member 17 includes a first flat surface 17*a* that is a surface protruding in a direction opposite to the conveying direction orthogonal to the cutting direction X1, a second flat surface 17*b* retracted at a predetermined distance from the first flat surface 17*a*, and a slope portion 17*c* that joins the first flat surface 17*a* and the second flat surface 17*b* together.

The first flat surface 17*a* protrudes to the degree that the thrust suppressing portion 28*a* of the pressing member 28 is pushed in and brought nearly into contact with the downstream side holding portion 21. That is, when the cutter unit 12 is in a position where the pressing member 28 is pushed in by the first flat surface 16*a*, the pressing force F exerted on the lower movable blade 13*b* by the upper movable blade 13*a* is maximized (pressing force F=F2). At the start of the cutting, inappropriate cutting is likely to result from separation of the blades caused by cutting resistance from the sheet. Thus, near the end of the rolled paper 1, the pressing force F exerted on the lower movable blade 13*b* by the upper movable blade 13*a* is maximized in order to suppress inappropriate cutting. That is, at the start of the cutting, the upper movable blade 13*a* and the lower movable blade 13*b* are brought into contact with each other by a strong force near the end of the rolled paper 1.

The second flat surface 17*b* is retracted to the degree that, with the thrust suppressing portion 27*a* of the external holder 27 in contact with the downstream side holding portion 21, the pressing member 28 does not contact the second flat surface 17*b*. As depicted in FIG. 9, when the pressing member 28 is in a position corresponding to the second flat surface 17*b* in the cutting direction, the pressing member 28 does not contact the second flat surface 17*b* and is thus not pushed in. When the cutter unit 12 is in this position, the pressing force F exerted on the lower movable blade 13*b* is minimized (pressing force F=F1). The minimized pressing force F exerted on the lower movable blade 13*b* restrains the durability of the upper movable blade 13*a* and the lower movable blade 13*b* from being degraded as a result of the wear of the blades.

In connection with movement of the cutter unit 12 in the cutting direction X1, the first flat surface 17*a* is arranged such that at least when the cutting point 15 of the cutter unit 12 reaches the cutting start point P2 where the cutting of the rolled paper 1 is started, the pressing member 28 comes into contact with the first flat surface 17*a*. The slope portion 17*c* is arranged so as to extend from a position to which, during the cutting, the cutting point 15 of the cutter unit 12 moves a predetermined distance after passing through the cutting start point P2. Specifically, the first flat surface 17*a* is provided so as to extend from a position closer to the standby position P1 than the cutting start point P2 in the cutting direction to a position slightly closer to the standby position than the end of the rolled paper 1 in the cutting direction. Thus, the pressing member 28 remains in contact with the first flat surface 17*a* until the cutting point 15 reaches the cutting start point P2.

The slope portion 17*c* smoothly joins the first flat surface 17*a* and the second flat surface 17*b* together to suppress a rapid change in the position of the external holder 27 via the pressing member 28, thus restraining damage to the upper movable blade 13*a* and the lower movable blade 13*b* caused by a rapid change in the pressing force F. The slope portion 17*c* may be a flat surface or a curved surface as long as the slope portion 17*c* allows the first flat surface 17*a* and the second flat surface 17*b* to be smoothly joined together. In the above description, the second flat surface 17*b* is retracted to the degree that, with the thrust suppressing portion 27*a* of the external holder 27 in contact with the downstream side holding portion 21, the pressing member 28 does not contact the second flat surface 17*b*. However, the present embodiment is not limited to this configuration. For example, the second flat surface 17*b* may be positioned to the degree that the thrust suppressing portion 27*a* of the external holder 27 contacts the downstream side holding portion 21, specifically, to the degree that the thrust suppressing portion 27*a* of the external holder 27 contacts the downstream side holding portion 21.

As described above, the pressing force changing member 62 and the downstream support member 17 provided in the cutting apparatus 5 enable the pressing force F exerted on the lower movable blade 13*b* to be changed while the rolled paper 1 is being cut. That is, near the cutting start point of the rolled paper 1 where the blades have difficulty biting into the sheet, the pressing force exerted on the lower movable blade 13*b* is set to a large value. This allows the blades to more reliably contact each other, suppressing possible inappropriate cutting resulting from separation of the blades caused by cutting resistance from the sheet. On the other hand, in an area corresponding to a time following the start of the cutting, the inappropriate cutting resulting from separation of the blades is unlikely to occur. Thus, the pressing force F exerted on the lower movable blade 13*b* is set to a small value to suppress degradation of durability resulting from the wear of the blades.

In connection with movement of the cutter unit 12 in the cutting direction X1, the first flat surface 17*a* is arranged such that the pressing member 28 comes into contact with the first flat surface 17*a* at least at the cutting start point P2 where the cutter unit 12 starts cutting the rolled paper 1. The slope portion 17*c* is arranged so as to extend from a position to which, during the cutting, the cutter unit 12 moves a predetermined distance after passing through the cutting start point P2. In this regard, the predetermined distance is determined with a variation in the sheet end position of the rolled paper 1 taken into account and, for example, corresponds to one rotation of the upper movable blade 13*a* following the start of the cutting of the rolled paper 1. In the present embodiment, the predetermined distance is 5 to 80 mm from the cutting start point P2.

In the present embodiment, the first flat surface 17*a* extends from a position corresponding to time preceding the start of the cutting to a position where the cutting point 15 reaches the cutting start point P2. The first flat surface 17*a* may be formed at a position corresponding to a time immediately before the end of the cutting to increase the pressing force F to enhance the cutting performance. This configuration prevents a situation where the sheet above the sheet discharge guide 11 falls obliquely starting with the cutting start side of the sheet, to raise the uncut part of the sheet, resulting in inappropriate cutting.

The rack member changes the peripheral speed of the lower movable blade 13*b*. The rack member 41 is provided on the guide rail 10, and meshes with and forcibly rotates the lower movable blade 13*b* to change the peripheral speed of the lower movable blade 13*b* as depicted in FIG. 6. The rack member 41 is arranged such that at least at the cutting start point P2 where the cutter unit 12 starts cutting the rolled paper 1, the rotation input gear 40*a* meshes with the rack member 41 to forcibly rotate the lower movable blade 13*b* as depicted in FIG. 6. That is, at the cutting start point P2 where cutting is started, the rotation input gear 40*a* (pinion gear) meshes with the rack member 41 to make the peripheral speed V2 of the lower movable blade 13*b* higher than the cutting speed V1 corresponding to the moving speed of the cutter unit 12.

The peripheral speed V2 of the lower movable blade 13*b* is increased to allow the blades to appropriately bite into the sheet at the start of the cutting. This suppresses a situation where the sheet starts to be deformed at the position of abutting contact with the blades and is thus pushed in the cutting direction X1, resulting in inappropriate cutting. In the present embodiment, the rack member 41 is arranged so as to extend from the standby position P1 to a predetermined position at which the cutter unit 12 arrives after passing through the cutting start point P2. That is, the rack member 41 is arranged so as to extend from the cutting start point P2 to a position where the rolled paper 1 has been cut by a predetermined length. In this regard, the predetermined length is set with a variation in the sheet end position of the rolled paper 1 taken into account. In the present embodiment, for example, the rack member 41 is arranged so as to extend from a position where the upper movable blade 13*a* starts cutting the rolled paper 1 to a position where the rolled paper 1 makes one rotation, that is, to a position 5 to 80 mm away from the position corresponding to the start of the cutting.

As the cutter unit 12 further moves in the cutting direction X1, the cutter unit 12 encounters an area where the rack member 41 is not provided as depicted in FIG. 7. That is, the rotation input gear 40*a* does not mesh with the rack member 41. Thus, when the rolled paper 1 is cut, the lower movable blade 13*b* is rotated by the frictional force between the lower movable blade 13*b* and the rolled paper 1. At this time, the peripheral speed V2 is approximately equal to the cutting speed V1 corresponding to the moving speed of the cutter unit 12. When the rolled paper 1 is not cut (during a moving operation following the end of the cutting or the like), the peripheral speed V2 of the lower movable blade 13*b* is zero. Consequently, the upper movable blade 13*a* and the lower movable blade 13*b* do not rotate relative to each other.

In the present embodiment, the rack member 41 rotates the lower movable blade 13*b*. However, the present embodiment is not limited to this configuration. The upper movable blade 13*a* may be rotated or both the upper movable blade 13*a* and the lower movable blade 13*b* may be rotated.

As described above, when the peripheral speed changing member installed in the cutting apparatus 5 is provided on a part of the guide rail 10, it is possible to set the area where one of the movable blades is forcibly rotated while the rolled paper 1 is being cut and the area where neither of the movable blades are rotated while the rolled paper 1 is being cut. This enables the peripheral speed V2 of the lower movable blade 13*b* to be changed. In the present embodiment, near the cutting start point of the rolled paper 1 where the blades have difficulty biting into the sheet, the rack member 41 is provided to set a high peripheral speed V2 for the lower movable blade 13*b* to allow the blades to approximately bite into the sheet. This suppresses a situation where the sheet starts to be deformed at the position of abutting contact with the blades and is thus pushed in the cutting direction X1, resulting in inappropriate cutting.

On the other hand, in an area corresponding to a time following the start of the cutting, the inappropriate cutting resulting from pushing of the sheet in the cutting direction X1 is unlikely to occur. Thus, the rack member 41 is omitted to make the peripheral speed V2 approximately equal to the cutting speed to suppress degradation of the cutting quality such as a large amount of paper dust from the cutting surface or degradation of durability of the blades. Moreover, in an area where the sheet is not cut, the peripheral speed V2 of the lower movable blade 13*b* is zero, and the blades are protected from wear resulting from relative rotation of the blades. This restrains the durability of the upper movable blade 13*a* and the lower movable blade 13*b* from being degraded.

Figure 10:
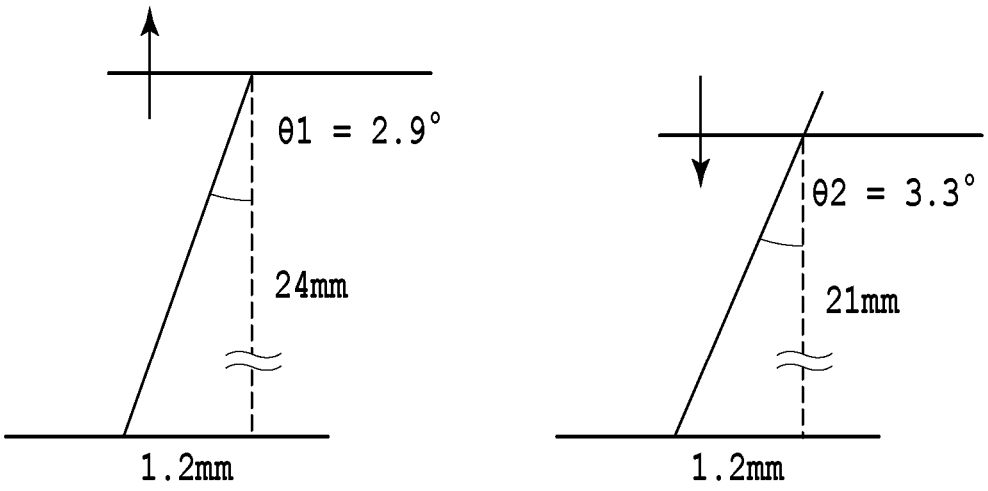
FIG. 10 is a diagram depicting a variation in crossing angle.

FIG. 10 is a diagram depicting a variation in the crossing angle θ between the two blades. Differences in the cutting performance and the cutting quality occur based on the moving distance of the slide member 22 of the crossing angle changing member 61 in the present embodiment and the crossing angle θ achieved by the slide member 22. As depicted in the schematic diagram in FIG. 10, the amount of misalignment between the groove portion 22*a* in the slide member 22 and the groove portion 21*b* in the downstream side holding portion 21 with respect to the cutting direction X1 is 1.2 mm in the present embodiment. A slide area L1 is 3.0 mm. In this state, when the slide member 22 slides farthest toward the upstream side holding portion 20, the distance between the groove portion 22*a* in the slide member 22 and the groove portion 21*b* in the downstream side holding portion 21 is 24 mm, and a crossing angle θ1 is approximately 2.9°. When the slide member 22 slides farthest from the upstream side holding portion 20, the distance between the groove portion 22*a* in the slide member 22 and the groove portion 21*b* in the downstream side holding portion 21 is 21 mm, and a crossing angle θ2 is approximately 3.3°.

FIG. 11 is a table indicating the results of experiments in which differences in cutting performance and cutting quality were checked when the crossing angle θ between the two blades was changed. The cut member is a cloth. This is a type of print medium into which the blades have the greatest difficulty biting. The table indicates the number of successful cuttings and the amount of waste resulting from breakage of a reception layer that receives ink during the cutting; the results were obtained with the crossing angle θ changed for solid white sheets with no image printed thereon and sheets printed in solid black.

At a crossing angle θ of 2.9°, inappropriate cutting occurred at the start of the cutting after approximately 300 to 400 cuttings had been performed. In contrast, when the crossing angle θ was increased to 3.3°, 700 to 800 cuttings were successfully performed for sheets with solid black images and 900 to 1,000 cuttings were successfully performed for unprinted sheets; the number of possible cuttings increased by a factor or two or more. However, when the amount of waste resulting from breakage of the reception layer and remaining on the sheet discharging guide 11 was checked after the cutting, the amount at a crossing angle of 3.3° was larger than the amount at a crossing angle of 2.9°, indicating degraded cutting quality. It has thus been found that the number of cuttings (cutting performance) can be increased by setting the crossing angle θ to 3.3° at the start of the cutting and that subsequent generation of waste as a result of breakage of the reception layer (degraded cutting quality) can be suppressed by reducing the crossing angle θ to 2.9°.

In the present embodiment, the crossing angle between the two blades is changed during the cutting operation to enable enhancement of the cutting performance at the start of the cutting and suppression of generation of paper dust as a result of the cutting.

In the present embodiment, the angle of one blade of the pair of blades is changed to allow for a change in the crossing angle between the two blades. At this time, instead of the shaft of the one blade (upper movable blade rotating shaft 19*a*) itself, the slide member 22 supporting the shaft is moved in a direction crossing the cutting direction (in the present embodiment, a direction substantially perpendicular to the cutting direction). Thus, the accuracy of change of the crossing angle can be improved regardless of a reaction force from the paper or the like.

In the present embodiment, the sliding distance of the slide member 22 pivotally supporting the upper movable blade rotating shaft 19*a* is adjusted using the groove portion 22*a* formed in the upstream side holding portion 20 and the groove portion 21*b* formed in the downstream side holding portion 21. Thus, the sliding distance can be accurately managed.

In the present embodiment, the cutting apparatus 5 includes the crossing angle changing member 61 and the pressing force changing member 62. However, the present embodiment is not limited to this configuration. In other words, the cutting apparatus 5 may include at least one of the crossing angle changing member 61, the pressing force changing member 62, and the peripheral speed changing member 63 as a cutting condition changing device.

In the description of the present embodiment, as the cutting conditions, the crossing angle, which is the angle to the blade cutting direction, the pressing force of the blades, and the peripheral speed of the blades are changed. Alternative cutting conditions are such that the cutting speed at which the blades move in the cutting direction of the print medium is set to a small value for the initial stage of the cutting and subsequently increased to allow for appropriate biting into the print medium and a reduction in the number of subsequent cuttings, enabling appropriate cutting.

In the description of the present embodiment, the cut medium is cut using the two blades. However, the present embodiment is not limited to this configuration. The cut medium may be cut using one blade.

As described above, the cutting apparatus of the present embodiment changes the cutting conditions during the cutting. Thus, a cutting apparatus and a printing apparatus can be provided which allow the blades to appropriately bite into the cut medium at the start of the cutting and which also enable a high quality cutting surface to be provided in the subsequent cutting, achieving appropriate cutting.

The cutting apparatus in the present embodiment uses the circular blades both of which are rotatable and is thus advantageous compared to cutting apparatuses using knife-like blades. That is, the circular blades provide an appropriate cut end surface, enable a variety of print media to be cut, and have long lives. Furthermore, compared to fixed blades one of which is elongate, the circular blades needs lower costs and a smaller space.

A printing apparatus with the cutting apparatus described in the present embodiment can produce similar effects.

Second Embodiment

A second embodiment will be described below with reference to the drawings. A basic configuration of the present embodiment is similar to the basic configuration of the first embodiment. Thus, only characteristic parts of the configuration will be described below.

Figure 12:
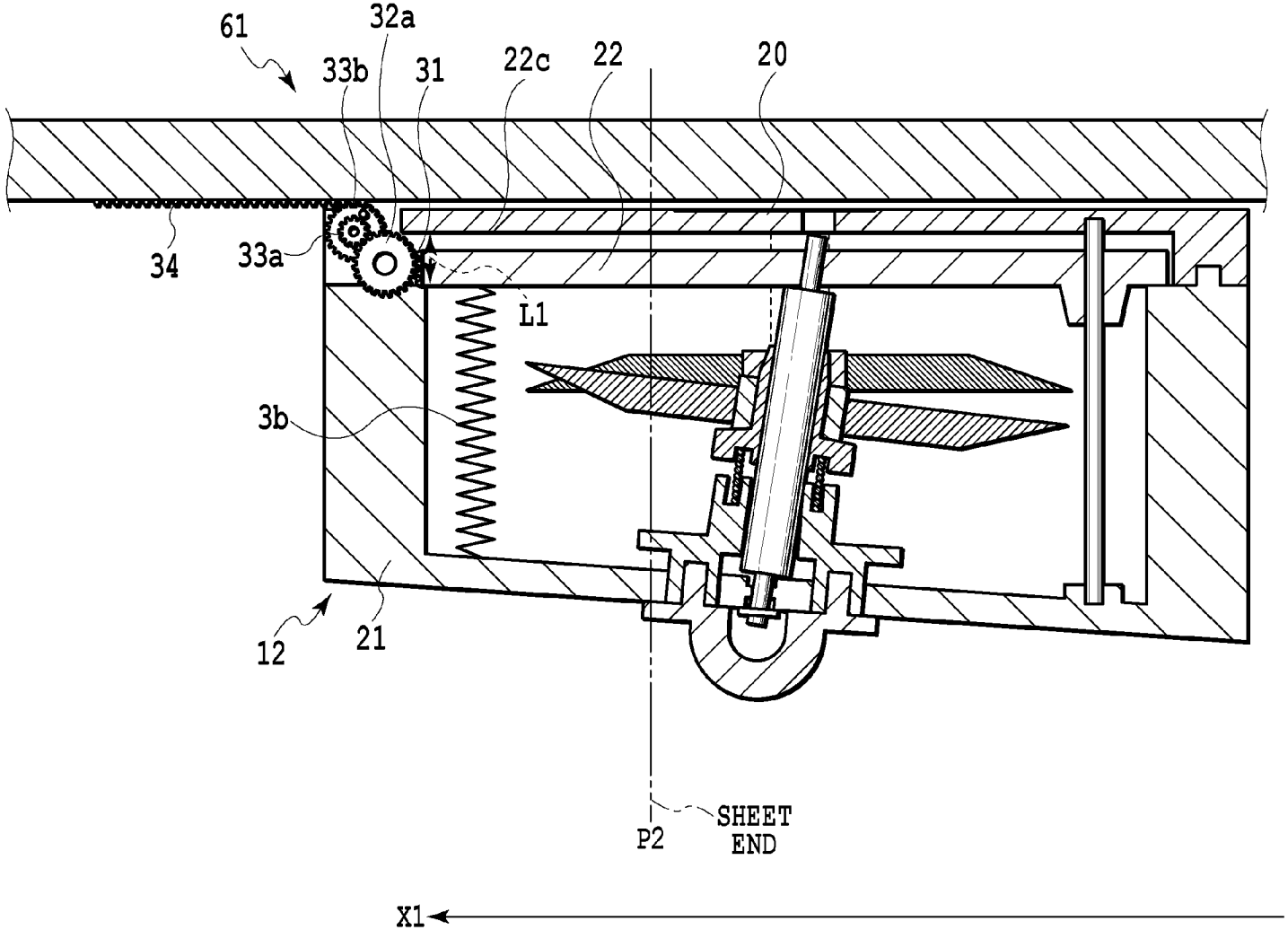
FIG. 12 is a sectional view illustrating that the cutter unit is in the position of a cutting point.
Figure 13:
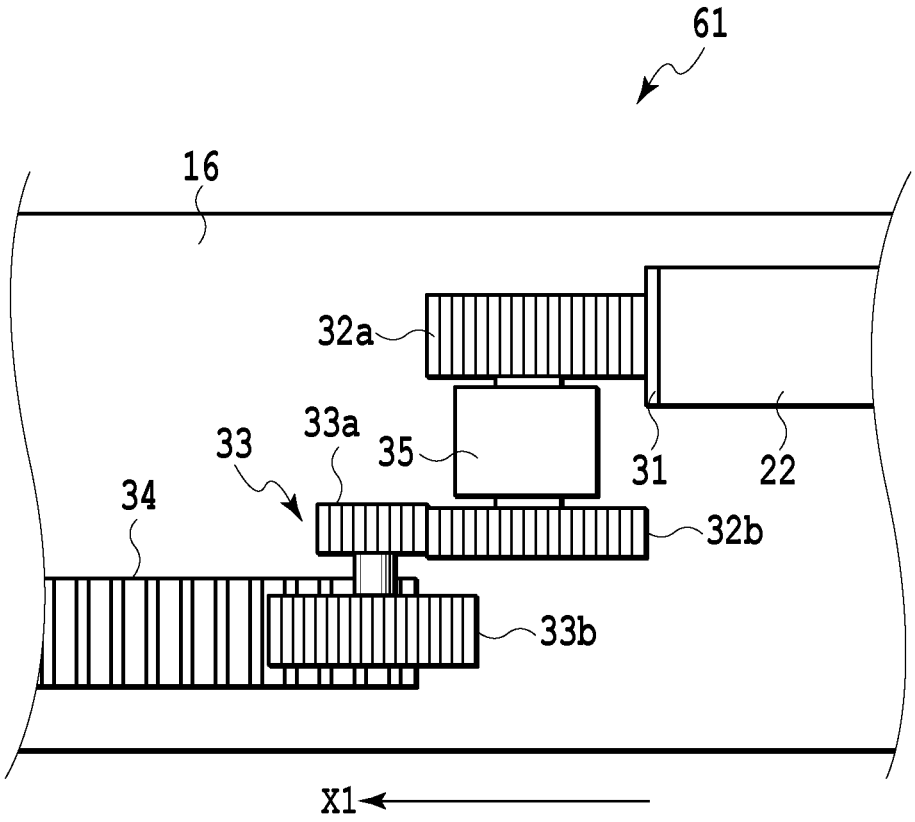
FIG. 13 is a front view depicting a crossing angle changing member.

FIG. 12 is a sectional view illustrating that the cutter unit 12 is in the position of the cutting start point P2. FIG. 13 is a front view depicting a crossing angle changing member according to the present embodiment. A modification of the crossing angle changing member 61 is illustrated below. However, the same components as those of the first embodiment are denoted by the same reference numerals and will not be described below.

As depicted in FIG. 12, the crossing angle changing member 61 of the present embodiment includes the slide member 22 and a gear train provided on a side surface of the slide member 22. A rack surface 31 is provided at one end of the slide member 22 in the cutting direction X1. A first gear 32*a* that meshes with the slide rack surface 31 is installed in the cutter unit 12. As depicted in FIG. 13, the first gear 32*a* is connected to a second gear 32*b* via a shaft, and a torque limiter 35 is arranged between the first gear 32*a* and the second gear 32*b*.

The second gear 32*b* meshes with a smaller-diameter portion 33*a* of a stepped gear 33. A larger-diameter portion 33*b* of the stepped gear 33 meshes with a support portion rack surface 34 provided on a surface of the upstream support member 16. As depicted in FIG. 12, the support portion rack surface 34 is placed in a position where the larger-diameter portion 33*b* meshes with the support portion rack surface 34 after the cutting point 15 (see FIG. 7) reaches the cutting start point P2. In this regard, the length of the support portion rack surface 34 is set larger than the rotating distance of the larger-diameter portion 33*b* of the stepped gear 33 determined based on a slide amount L1 of the slide member 22 with a gear ratio taken into account.

The slide member 22 is biased in the conveying direction by a spring 36 from the time when the cutter unit 12 is placed in the standby position P1 until the cutting point 15 reaches the cutting start point P2. Thus, the slide member 22 is present in a position farthest from the upstream side holding portion 20, and in this case, the crossing angle θ is maximized.

In this configuration, when the cutter unit 12 moves in the cutting direction X1, after the cutting point 15 reaches the cutting start point P2, the larger-diameter portion 33*b* of the stepped gear 33 meshes with the support portion rack surface 34 and starts to rotate. The rotation of the larger-diameter portion 33*b* of the stepped gear 33 also rotates the smaller-diameter portion 33*a* of the stepped gear 33. Accordingly, the slide member 22 with the slide rack surface 31 moves toward the upstream side holding portion 20, and the abutting contact portion 22*c* comes into abutting contact with the retaining portion 20*a*, stopping the slide member 22. In this state, the crossing angle θ is minimized.

In this regard, the length of the support portion rack surface 34 is set larger than the rotating distance of the larger-diameter portion 33*b* of the stepped gear 33 determined based on the slide amount L1 of the slide member 22 with a gear ratio taken into account. Thus, even after the slide member 22 is stopped, the support portion rack surface 34 remains meshed with the larger-diameter portion 33*b* of the stepped gear 33. However, after the abutting contact portion 22*c* comes into abutting contact with the retaining portion 20*a*, the torque limiter 35 runs idly to prevent transmission of the rotation, in turn preventing movement of the slide member 22.

Similarly, when the cutter unit 12 moves in the direction opposite to the cutting direction X1, the abutting contact portion 22*c* rotates until the abutting contact portion 22*c* comes into abutting contact with the sliding suppressing portion 21*a*, leading to the largest crossing angle θ. Even after the abutting contact portion 22*c* comes into abutting contact with the sliding suppressing portion 21*a*, the larger-diameter portion 33*b* of the stepped gear 33 keeps rotating. However, after the abutting contact portion 22*c* comes into abutting contact with the sliding suppressing portion 21*a*, the torque limiter 35 runs idly to prevent transmission of the rotation, in turn preventing movement of the slide member 22.

In this manner, a slide amount L1 of sliding can be reliably performed to obtain the desired amount of change in crossing angle. The rotating distance of the first gear 32*a* and the moving distance of the slide rack surface 31 are small compared to the length of the support portion rack surface 34 and the rotating distance of the larger-diameter portion 33*b* of the stepped gear 33. Thus, the crossing angle θ is gradually reduced to avoid imposing a load on the rotary blade, while increasing the accuracy of the moving distance.

As described above, the slide member 22 is moved by the action of the gear and rack to change the crossing angle θ, which is a cutting condition. Thus, a cutting apparatus and a printing apparatus can be provided which allow the blades to appropriately bite into the cut medium at the start of the cutting and which also enable a high quality cutting surface to be provided in the subsequent cutting, achieving appropriate cutting.

Other Embodiments

In the above-described embodiments, after the cutting point 15 of the cutter unit 12 passes through the cutting start point P2 and then moves a predetermined distance (the distance corresponding to one rotation of the upper movable blade 13*a* following the start of the cutting), the contact portion 22*b* is placed in the position corresponding to the slope portion 16*c*, and the pressing member 28 is placed in the position corresponding to the slope portion 16*c*. However, the present invention is not limited to this embodiment. A timing when the contact portion 22*b* reaches the slope portion 16*c* may be different from a timing when the pressing member 28 reaches the slope portion 16*c*.

In the above-described embodiments, the serial ink jet printing apparatus has been described. However, the embodiments are applicable to what is called a line head printing apparatus in which nozzles in a print head are arranged in juxtaposition in a direction orthogonal to the sheet conveying direction (sheet width direction). Furthermore, the printing scheme is not limited to image printing based on the ink jet scheme using a liquid ink for image printing. A solid ink may be used as a print agent, and various schemes such as an electrophotographic scheme using toner and a sublimation scheme may be adopted. Additionally, the present invention is not limited to color printing using print agents in a plurality of colors, but monochrome printing using only black (including gray) may be performed.

In the above-described embodiments, the printing apparatus with the cutting apparatus has been described. However, the embodiments can also be applied to a configuration only with the cutting apparatus.

The cutting apparatus in which the upper movable blade and the lower movable blade are rotating disc-like circular blades has been described. However, the cutting apparatus may include a rotating circular blade and an elongate fixed blade. In this case, the crossing angle between the circular blade and the fixed blade may be changed by changing the angle of the circular blade. Alternatively, the peripheral speed of the circular blade may be switched.

Besides paper, plastic sheets, photographic printing paper, cloths, and the like, a variety of sheet-like materials may be used as cut media. In the above description, the rolled paper has been taken as an example of the cut medium cut by the cutting apparatus. However, the present invention is not limited to rolled cut media. Continuous sheets that are not rolled and the like may be used, and any media that can be cut by the cutting apparatus may be used.

Even a printing apparatus using knife-like blades instead of the circular blades enables the crossing angle θ to be changed. The cutting apparatus may include knife-like blades.

The configuration that cuts the cut medium by moving the cutting apparatus has been described. However, the present invention is applicable to a cutting apparatus configured to cut the cut medium by moving the cut medium instead of moving the cutter unit.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-183371, filed Sep. 9, 2014, which is hereby incorporated by reference wherein in its entirety.

What is claimed is:

1. A cutting apparatus comprising:

a cutting unit including a first blade member and a second blade member that cooperates with the first blade member in cutting an object, configured to cut the object by moving the object and at least one of the first and second blade members relative to each other in a cutting direction; and a changing unit configured to change a crossing angle between the first blade member and the second blade member during an operation of cutting the object, wherein the changing unit makes the crossing angle after the start of the cutting smaller than the crossing angle at the start of the cutting.

2. The cutting apparatus according to claim 1, wherein the changing unit changes the crossing angle by an initial cutting operation from the start of the cutting of the object until a predetermined length of the cutting is performed and a subsequent printing operation.

3. The cutting apparatus according to claim 1, wherein the changing unit changes an angle of the first blade member of the first and second blade members.

4. The cutting apparatus according to claim 1, wherein each of the first blade member and the second blade member is a circular blade member provided so as to be rotatable and comprises peripheral blades, and the changing unit changes the crossing angle by changing an angle of a rotating shaft of the first blade member relative to a rotating shaft of the second blade member.

5. The cutting apparatus according to claim 4, wherein the changing unit changes the crossing angle by moving a slide unit, that supports one end of the rotating shaft of the first blade member, in a direction crossing the cutting direction.

6. The cutting apparatus according to claim 5, wherein the slide unit is held in an area between a groove portion formed in a first holding member and a groove portion formed in a second holding member, and is able to slide in the area.

7. The cutting apparatus according to claim 6, further comprising a pressing spring configured to bias the slide unit in a direction in which the slide unit is pressed against the first holding member.

8. The cutting apparatus according to claim 5, wherein the cutting unit moves along a support unit to cut the object, the support unit includes a protruding portion, the slide unit includes a contact portion protruding toward a surface of the support unit that includes the protruding portion, and the changing unit changes the crossing angle according to a change in a state of contact between the support unit and the contact portion resulting from movement of the cutting unit.

9. The cutting apparatus according to claim 8, wherein the protruding portion pushes the contact portion to increase the crossing angle.

10. The cutting apparatus according to claim 5, wherein the changing unit changes the crossing angle by changing the angle of the rotating shaft of the first blade member relative to the rotating shaft of the second blade member by an action of a gear and a rack.

11. The cutting apparatus according to claim 10, wherein the cutting unit moves along a support unit to cut the object, the support unit includes a first rack, the slide unit includes a second rack at one end of the slide unit, as the cutting unit moves, a first gear provided in the changing unit meshes with the first rack to rotate the first gear, and a second gear meshing with the second rack thus rotates to move the slide unit to change the crossing angle.

12. A printing apparatus comprising:

an image printing unit configured to print an image on an object;

a cutting unit including a first blade member and a second blade member that cooperates with the first blade member in cutting an object, configured to cut the object by moving the object and at least one of the first and second blade members relative to each other in a cutting direction; and a changing unit configured to change a crossing angle between the first blade member and the second blade member during an operation of cutting the object, wherein the changing unit makes the crossing angle after the start of the cutting smaller than the crossing angle at the start of the cutting.

* * * * *